United States Patent [19]

Evans et al.

[11] 4,035,185

[45] July 12, 1977

[54] BLENDED INTERNAL LATENT IMAGE EMULSIONS, ELEMENTS INCLUDING SUCH EMULSIONS AND PROCESSES FOR THEIR PREPARATION AND USE

[75] Inventors: Francis J. Evans, Rochester; Robert E. Atwell, Spencerport, both of N.Y.

[73] Assignee: Eastman Kodak Company, Rochester, N.Y.

[21] Appl. No.: 653,799

[22] Filed: Jan. 30, 1976

Related U.S. Application Data

[63] Continuation-in-part of Ser. No. 539,474, Jan. 8, 1975, abandoned.

[51] Int. Cl.[2] ..... G03C 5/54; G03C 1/28; G03C 5/24

[52] U.S. Cl. ..... 96/29 R; 96/63; 96/64; 96/76 R; 96/107; 96/108

[58] Field of Search ..... 96/108, 29 R, 64, 63, 96/76 R, 107

[56] References Cited

U.S. PATENT DOCUMENTS

| | | | |
|---|---|---|---|
| 3,317,322 | 5/1967 | Porter et al. | 96/108 |
| 3,761,276 | 9/1973 | Evans | 96/108 |
| 3,942,986 | 3/1976 | Florens | 96/108 |

*Primary Examiner*—Won H. Louie, Jr.
*Attorney, Agent, or Firm*—Carl O. Thomas

[57] ABSTRACT

A photographic silver halide emulsion capable of forming on exposure an internal latent image can be formed having a desired characteristic curve by providing a first photographic silver halide emulsion comprised of silver halide grains internally sensitized with a combination of middle chalcogen and noble metal sensitizers capable of forming on exposure an internal latent image and blending therewith a second, higher contrast photographic silver halide emulsion comprised of silver halide grains internally sensitized with a relatively lower proportion of middle chalcogen to noble metal sensitization. Both the first and second photographic silver halide emulsions are sensitized with the same middle chalcogen and noble metal sensitizers.

20 Claims, No Drawings

BLENDED INTERNAL LATENT IMAGE EMULSIONS, ELEMENTS INCLUDING SUCH EMULSIONS AND PROCESSES FOR THEIR PREPARATION AND USE

This is a continuation-in-part of copending, commonly assigned U.S. application Ser. No. 539,474, filed Jan. 8, 1975, now abandoned.

The present invention is directed to photographic elements and silver halide emulsions capable of forming on exposure an internal latent image containing silver halide grains which are internally sensitized with a combination of middle chalcogen and noble metal sensitizers. The invention is additionally directed to a process of blending to produce such photographic silver halide emulsions.

It is generally known to those skilled in the photographic silver halide emulsion arts that chemical sensitization of silver halide grains increases photographic speeds. Chemical sensitization has been categorized as (1) sulfur, selenium and/or tellurium sensitization, referred to collectively in this patent application as middle chalcogen sensitization, (2) nobel metal sensitization, typically using gold and other noble Group VIII metals and (3) reduction sensitization, using various types of reducing agents or by increasing silver ion concentration in the emulsion—i.e., lowering the pAg. It is additionally known to those skilled in the art that additional speed increases can be achieved by employing combinations of these chemical sensitization approaches. Middle chalcogen and noble metal sensitization, particularly sulfur and gold sensitization, have been widely recognized to provide photographic emulsions of superior speed. In most patents which disclose inventions in photographic silver halide emulsions some reference is included to chemical sensitization—particularly gold and/or sulfur sensitization.

Most photographic silver halide emulsions, including those commonly used to make positive transparencies, are negative working. Such emulsions employ silver halide grains that are chemically sensitized on their surfaces—i.e., surface sensitized. As shown in the comparative example, in preparing silver halide emulsions that are surface sensitized with sulfur and gold the degree of sulfur sensitization as compared to gold sensitization can affect the contrast of the emulsion, that is, the slope of its characteristic curve. Within normal concentration limits a greater degree of sulfur sensitization as compared to gold sensitization will result in a higher contrast.

In recent years a considerable amount of interest has developed in photographic silver halide emulsions in which the silver halide grains have been internally sensitized to permit the formation of an internal latent image. In most instances internally sensitized silver halide grains have been used to form positive working emulsions, referred to as direct-positive emulsions, by using surface fogging developers or by overall light exposure during development. Internal latent image emulsions can also be made negative working by using an internal developer.

One approach for producing internally sensitized photographic silver halide emulsions is to provide a core emulsion and to sensitize chemically the surface of the silver halide grains, as with middle chalcogen and/or gold, using conventional surface sensitization techniques. The core emulsion can then be blended with another emulsion comprised of silver halide grains of comparatively small size, referred to as a shell emulsion. Upon Ostwald ripening of the blended emulsion the smaller grains form a shell on the larger surface-sensitized grains so that the final, covered grains exhibit internal rather than surface sensitization. Alternatively, additional silver halide can be precipitated directly onto the silver halide grains of the core emulsion after chemical sensitization. In this instance, chemical sensitization is most conveniently undertaken by interrupting silver halide precipitation between the formation of the core and shell of the silver halide grains. Thus, the most common approach to internal sensitization with a combination of middle chalcogen and noble metal sensitization has been simply to apply known procedures for surface sensitization and then to cover the surface of the grains with additional silver halide.

It has been observed quite unexpectedly that the proportion of middle chalcogen to noble metal sensitization for a silver halide emulsion produces a dissimilar effect in the characteristic curve of the emulsion, depending upon whether the emulsion is internally or surface sensitized. Whereas a higher proportion of middle chalcogen sensitization produces a higher contrast surface-sensitized silver halide emulsion, a higher proportion of middle chalcogen sensitization produces a lower contrast internally sensitized silver halide emulsion. This offers a novel, useful and unexpected approach for modifying the characteristic curve, particularly the slope of the characteristic curve, for a photographic silver halide emulsion capable of forming an internal latent image.

In one aspect, this invention is directed to a photographic silver halide emulsion comprised of silver halide grains internally sensitized with a combination of middle chalcogen and noble metal sensitizers capable of forming on exposure an internal latent image. It is the improvement of this invention that the characteristic curve of the emulsion is the product of a mixture of silver halide grains internally sensitized with the same middle chalcogen and noble metal sensitizers comprised of lower contrast producing silver halide grains exhibiting a comparatively higher proportion of middle chalcogen to noble metal sensitization and higher contrast producing silver halide grains exhibiting a comparatively lower proportion of middle chalcogen to noble metal sensitization.

In another aspect my invention is directed to a process of modifying a photographic silver halide emulsion capable of forming on exposure an internal latent image to exhibit a desired characteristic curve. It is our improvement to provide a first photographic silver halide emulsion comprised of silver halide grains internally sensitized with a combination of middle chalcogen and noble metal sensitizers capable of forming on exposure an internal latent image and to blend therewith a second, higher contrast photographic silver halide emulsion comprised of silver halide grains internally sensitized with a relatively lower proportion of middle chalcogen to noble metal sensitization, wherein both the first and second emulsions are sensitized with the same middle chalcogen and noble metal sensitizers.

My invention can be practiced using any conventional photographic silver halide emulsion internally sensitized with a combination of middle chalcogen and noble metal sensitizers capable of forming an internal latent image. In order to practice my invention it is merely necessary to blend together two or more similarly sensitized such emulsions wherein one of the emulsions exhibits a lower contrast by reason of containing a higher proportion of middle chalcogen sensitization as compared with noble metal sensitization.

The individual emulsions to be blended can be formed by conventional tecniques. Exemplary preferred techniques for forming photographic silver halide emulsions are disclosed by Porter et al. U.S. Pat. Nos. 3,206,313 and 3,317,322, issued Sept. 14, 1965 and May 2, 1967, respectively, and Evans U.S. Pat. No. 3,761,276, issued Sept. 25, 1973, the disclosures of which are here incorporated by reference. As set out in these patents, an internally sensitized emulsion can be formed by first chemically sensitizing the surface of a core emulsion. The core emulsion can take the form of any conventional surface-sensitive silver halide emulsion. To be considered surface-sensitive an emulsion must under comparable conditions exhibit a greater sensitivity to exposure when developed in a surface developer than when surface bleached and then processed in an internal developer. Conventional photographic silver halide emulsion types are set out in Product Licensing Index, Vol. 92, December 1971, publication 9232, paragraph I.

The core emulsions can be chemically sensitized with noble metal and middle chalcogen sensitizers either concurrently or sequentially using techniques well understood by those skilled in the art. Illustrative of known techniques for achieving noble metal and/or middle chalcogen sensitization are those contained in Sheppard U.S. Pat. No. 1,574,944, issued Mar. 2, 1926 and 1,623,499, issued Apr. 5, 1927; Sheppard et al. U.S. Pat. No. 2,410,689, issued Nov. 5, 1947; Waller et al. U.S. Pat. No. 2,399,083, issued Apr. 23, 1946; Smith et al. U.S. Pat. No. 2,448,060, issued Aug. 31, 1948; Baldesiefen U.S. Pat. Nos. 2,540,085 and 2,540,086, both issued Aug. 31, 1948; Damschroder et al. U.S. Pat. No. 2,597,856, issued May 27, 1952; Damschroder et al. U.S. Pat. No. 2,642,361, issued June 16, 1953; Dunn U.S. Pat. No. 3,297,446, issued Jan. 10, 1967; McVeigh U.S. Pat. No. 3,297,447, issued Jan. 10, 1967; McVeigh U.S. Pat. Nos. 3,408,196 and 3,408,197, both issued Oct. 29, 1968; and Millikan et al. U.S. Pat. No. 3,753,721, issued Aug. 21, 1973.

As is illustrated by the above patents, a variety of sulfur, selenium and tellurium compounds can be employed as middle chalcogen sensitizers. Typical sulfur sensitizers include compounds such as allyl thiourea, allyl isothiocyanate, phenyl isothiocyanate, phenyl thiourea, carbanilide, thiourea, thiosemicarbazide, sodium, potassium or ammonium thiosulfate, thioacetamid, thioformamid, thiobarbituric acid and diacetylthiourea. Typical selenium sensitizers include compounds such as allyl isoselenocyanate, potassium selenocyanide, allyl selenourea and labile selenium compounds such as colloidal selenium, selenoacetone, selenoacetophenone, tetramethylselenourea, N-($\beta$-carboxyethyl)-N',N'-dimethyl selenourea, selenoacetamide, diethylselenide, triphenylphosphine selenide, tri-p-tolylselenophosphate tri-n-butylselenophosphate, 2-selenoproponic acid, 3-selenobutyric acid, methyl-3-selenobutyrate, allyl isoselenocyanate and dioctylselenourea. Typical tellurium compounds include allyl isotellurocyanate, potassium tellurocyanaide, allyl tellurourea and diacetylthiourea. Other conventional middle chalcogen sensitizers can, of course, be employed. In those instances where an active gelatin is employed in forming the photographic silver halide emulsion no further middle chalcogen sensitization is required.

The noble metal sensitizers typically take the form of salts of gold or Group VIII noble metals, such as ruthenium, rhodium, palladium, iridium, osmium and platinum. Among the noble metal compounds typically employed are compounds such as ammonium and potassium chloropalladate, ammonium, sodium and potassium chloroplatinate, ammonium, potassium and sodium bromoplatinate, ammonium chlororhodate, ammonium chlororuthenate, ammonium chloroiridate, ammonium, potassium and sodium chloroplatinite, ammonium, potassium and sodium chloropalladite, etc. Illustrative gold sensitizers include chloro-potassium aurate, potassium auriaurite, potassium auricyanaide, potassium aurithiocyanate, gold sulfide, gold selenide, gold iodide, potassium chloroaurate, ethylenediamine-bis-gold chloride and various organic gold compounds structurally shown in U.S. Pat. No. 3,753,721, issued Aug. 21, 1973.

While the chemical sensitizers can be added to photographic silver halide emulsions in any conventional manner, it is generally preferred to add the sensitizers concurrently to the core emulsions after the silver halide grains thereof have been fully formed. The chemical sensitizers can be added in the form of their aqueous solutions where they are soluble in water or in an innocuous organic solvent where the sensitizer does not have sufficient solubility in water to be used in the form of an aqueous solution. Particularly useful organic solvents include ethanol, methanol, pyridine, acetone, dioxane, etc. That is, organic solvents which have a rather high degree of polarity are usually preferred. Where it is desired to add the sensitizers in some other form than solution, this procedure is also possible, especially where the sensitizers are available in the form of a colloidal suspension. In some cases, it is possible to add the sensitizers suspended in an organic solvent which forms very small suspended particles or oil globules in the photographic emulsion similar to the type of particles produced in preparing coupler dispersions as described in Jelley et al. U.S. Pat. No. 2,322,027, issued June 15, 1943 and Fierke et al. U.S. Pat. No. 2,801,171, issued July 30, 1957. Dispersing media useful for this purpose include tricresyl phosphate, dibutyl phthalate, triphenyl phosphate, etc.

The degree to which a photographic silver halide emulsion is sensitized by a metal chalcogen or noble metal sensitizer is a function not only of the quantity of sensitizer added to the emulsion, but also of the time and temperature of digestion following addition of the sensitizer. In sensitizing the core emulsions employed in the practice of my invention I prefer to add concurrently the middle chalcogen and noble metal sensitizers after the silver halide grains of the core emulsion are fully formed. In this way I can control the degree of sensitization by each sensitizer by controlling the amount of sensitizer added. The concentration of each sensitizer can be varied depending upon the contrast desired in the final product, the specific sensitizer employed and the photographic speed desired. Typically middle chalcogen sensitizers have been found to be effective in amounts ranging from trace concentrations to 15 mg per mole of silver or more. Preferred concentrations of middle chalcogen sensitizers are typically from 0.1 to 10 mg per mole of silver. Typically noble metal sensitizers are employed in somewhat higher concentrations ranging from about 2 to 5 times that of the middle chalcogen sensitizer. Preferred concentrations of metal sensitizers typically range from about 1 to 40 mg per mole of silver, most preferably from about 1 to 20 mg per mole of silver. It is possible to wash excess sensitizer from the emulsion after digestion of the emulsion.

Other than being surface sensitive and being chemically sensitized with a combination of middle chalcogen and noble metal sensitizers, the core emulsions can take any convenient conventional form.

The chemically sensitized core emulsions can be converted to covered grain emulsions which are internally sensitized with a combination of middle chalcogen and noble metal sensitizers capable of forming an internal latent image by blending the sensitized core emulsion with another, finer grain silver halide emulsion, referred to as a shell emulsion, as taught by Porter et al. U.S. Pat. Nos. 3,206,313, and 3,317,322, cited above. The shell emulsion can be prepared according to techniques which have been previously described in the prior art. Methods for preparing such emulsions have been previously described by Trivelli and Smith in "The Photographic Journal," Vol. LXXXIX, May 1939, pages 330–338. While any of the usual slver halides, such as silver chloride, chlorobromide, and the like, can be used in the shell emulsions, particularly useful results have been obtained with silver bromide emulsions particularly silver bromide emulsions containing at least 90 mole percent of silver bromide. Other halides, up to about 10 percent can be used with the silver bromide emulsions. Silver bromide and silver bromoiodide emulsions (e.g., silver bromoiodide emulsions containing up to about 10 mole percent of iodide) have been found to be particularly useful in preparing the shell emulsions.

In general, it has been found that particularly useful results can be obtained by blending about 0.25 to about 8.0 molar equivalents of the shell emulsion per molar equivalent of the core or surface-sensitive emulsion. When these blends are held for several hours, usually for about 24 hours, at room temperature the shell grains dissolve and deposit upon the surface of the core grains to form a covered grain internal latent image emulsion useful in the practice of this invention.

Instead of forming the internal latent image emulsions useful in the practice of this invention by blending a core emulsion and a shell emulsion, it is possible to form useful emulsions by precipitating silver halide directly onto the surface of the silver halide grains of the core emulsion following chemical sensitization, as described in Evans U.S. Pat. No. 3,761,261, cited above. The silver halides precipitated directly onto the chemically sensitized core emulsion grains can be chosen similarly as described above in connection with the shell emulsions. Similarly the proportion of silver halide located within the core and the shell of the resulting covered grain emulsions formed by direct precipitation onto the core grains can be similar to that present when the shell is formed by Ostwald ripening.

The surface of the covered grain emulsions can be either sensitized or unsensitized, as is taught by Porter et al. U.S. Pat. Nos. 3,206,313 and 3,317,322, cited above. The internally sensitized covered grain emulsions can be surface sensitized with any conventional combination of chemical and optical sensitizers and can, if desired, be sensitized using the techniques described above for sensitizing the core emulsions. In those instances where it is desired to form direct-positive images using the internal image silver halide emulsions, it is preferred that the internal image silver halide grains be chemically sensitized to a level which will produce a density of less than 0.4 and preferably a density of less than 0.25 when imagewise exposed and developed in Kodak Developer DK-50 for five minutes at 27° C when coated at a coverage of between about 300 to about 400 mg of silver per square foot.

The surface developer referred to herein as Kodak Developer DK-50 is described in the Handbook of Chemistry and Physics, 30th ed., 1947, Chemical Rubber Publishing Co., Cleveland, Ohio, p. 2558, and has the following composition:

| | |
|---|---|
| Water, about 125° F (52° C) | 500.0 cc |
| N-methyl-p-aminophenol sulfate | 2.5 g |
| Sodium sulfite, desiccated | 30.0 g |
| Hydroquinone | 2.5 g |
| Sodium metaborate | 10.0 g |
| Potassium bromide | 0.5 g |
| Water to make | 1.0 liter. |

In order to form an internal latent image emulsion using the preparation procedures of Porter et al. it is preferred that the grain size distribution of the shell emulsions be such that the average grain size is not greater than $0.4\mu$, and preferably about $0.1\mu$. The average grain size distribution of the core emulsion should be such that the silver halide grain size has a diameter greater than about $0.8\mu$ (e.g., 0.8 to about $1.5\mu$). With the preparation procedure of Evans, the average grain size distribution of the core emulsion can be varied within a much wider range. Average grain size distributions of from $0.1\mu$ or less to $2.0\mu$ or more in diameter are contemplated, preferably from 0.5 to $1.5\mu$.

To form an internal latent image emulsion according to the teachings of this invention it is only necessary to blend together a first, higher contrast internal latent image emulsion internally sensitized with a combination of middle chalcogen and noble metal sensitizers and a second internal latent image emulsion similarly sensitized, but having a higher proportion of middle chalcogen as compared to noble metal sensitization, so that the second emulsion exhibits a lower contrast. The two emulsions can be blended by mechanical stirring or any other convenient conventional blending technique.

The resulting internal latent image emulsion exhibits a characteristic curve which reflects the contributions of the starting internal latent image emulsions blended. For example, using starting emulsions of comparable speed, the contrast of the resulting emulsion will be intermediate between the contrasts of the starting emulsions with the departure from the starting emulsion contrasts being generally inversely proportional to the relative amount of each starting emulsion present. When the starting emulsions are of unequal speed, the faster and slower starting emulsions will have a disproportionate influence on the toe and shoulder, respectively, of the characteristic curve for the blended internal latent image emulsion. It is, of course, recognized that more than two starting internal image emulsions can be blended to form an internal latent image emulsion according to this invention.

From the foregoing it is apparent that this invention offers an approach for obtaining internal latent image emulsions of more closely controlled characteristics than has heretofore been possible in the art. Since the relationship of middle chalcogen to noble metal sensitization of internal latent image emulsions in defining their characteristic curves was not previously appreciated by those skilled in the art, obtaining such an internal latent image emulsion of desired photographic characteristics—particularly contrast—has been largely achieved through trial and error. By reason of observing the relationship of middle chalcogen and noble metal sensitization to emulsion characteristics we can tailor emulsions to satisfy predetermined photographic parameters without resort to trial and error techniques.

In practicing this invention it is merely necessary to bring together two internal latent image emulsions that are differentially internally sensitized with middle chalcogen and noble metal so that the blending of one emulsion with the other produces an observable alternation of the resulting characteristic curve from that of the starting emulsions. Preferably the starting emulsions should differ in contrast by at least 0.1 under the conditions of development contemplated in use. For emulsions differing substantially in contrast, as little as 1 percent or less of a second internal latent image emulsion, based on total emulsion weight, can be relied upon to produce an observable differentiation in the resulting characteristic curve of the blended emulsion. It is generally preferred to choose the starting emulsions so that each constitutes from about 10 to about 90 percent of the blended emulsion, based on total weight.

Either before or after blending, the internal latent image emulsions of this invention can be provided with various conventional photographic addenda. For example, the emulsions can contain plasticizers, lubricants, coating aids, optical brighteners, antifoggants and stabilizers, hardeners, and color formers, such as couplers, as disclosed in *Product Licensing Index*, cited above, pages 107 through 110.

The photographic emulsions described in the practice of this invention can contain various colloids alone or in combination as vehicles, binding agents and various layers. Suitable hydrophilic materials include both naturally occurring substances such as proteins, for example, gelatin, gelatin derivatives, cellulose derivatives, polysaccharides such as dextran, gum arabic and the like; and synthetic polymeric substances such as all water-soluble polyvinyl compounds like poly(vinylpyrrolidone), acrylamide polymers and the like.

The described photographic emulsions employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example in U.S. Pat. Nos. 3,142,568 by Nottorf issued July 28, 1964; 3,193,386 by White issued July 6, 1965; 3,062,674 by Houck et al., issued Nov. 6, 1962; 3,220,844 by Houck et al. issued Nov. 30, 1965; 3,287,289 by Ream et al. issued Nov. 22, 1966; and 3,411,911 by Dykstra issued Nov. 19, 1968; particularly effective are those water-insoluble polymers or latex copolymers of alkyl acrylates and methacrylates, acrylic acid, sulfoalkyl acrylates or methacrylates, those which have cross-linking sites which facilitate hardening or curing, those having recurring sulfobetaine units as described in Canadian Patent 774,054 by Dykstra and those described in U.S. Pat. No. 3,488,708 by Smith issued Jan. 6, 1970.

It is appreciated that the blended emulsions of the present invention can take various forms, depending upon the intended photographic application. In one form silver halide grain surfaces of the blended emulsions of this invention can be used to produce direct-positive images as described, for example in Falleson U.S. Pat. No. 2,497,857, issued Jan. 4, 1955, Knott et al. U.S. Pat, No. 2,456,953, issued Dec. 21, 1948 and Ives U.S. Pat. No. 2,563,785, issued Aug. 7, 1951. In another form the blended internal latent image silver halide emulsion can include silver halide grains free of surface spectral sensitization and having a particle size in the range of from 0.15 to 0.8$\mu$ in diameter for the purpose of improving speed. Generally it is preferred that at least a 50%, or major portion, (on a weight basis) of the silver halide grains present in the blended emulsions of this invention be internally sensitized with a combination of middle chalcogen and noble metal sensitizers.

The blended internal latent image emulsions of the present invention can be coated onto conventional photographic supports of the type disclosed in *Product Licensing Index* (cited above) paragraph X, and coated as disclosed in paragraph XVIII of that publication, to form X-ray orthochromatic, panchromatic or infrared-sensitized photographic elements. The blended internal latent image emulsions can be employed to form one or more layers of a multi-color recording photographic element.

The photographic elements of this invention can be employed in conventional image transfer systems, if desired. Such systems are known to those skilled in the art. Colloid transfer systems are described in Yutzy et al. U.S. Pat. Nos. 2,596,756 issued May 13, 1952 and 2,716,059 issued Aug. 23, 1953. Silver salt diffusion transfer systems are described in Rott U.S. Pat. No. 2,352,014 issued June 20, 1944; Land U.S. Pat. No. 2,543,181 issued Feb. 27, 1951; Yackel et al. U.S. Pat. No. 3,020,155 issued Feb. 6, 1962 and Land U.S. Pat. No. 2,861,885, issued Nov. 25, 1958. Imbibition transfer systems are described in Minsk U.S. Pat. No. 2,882,156 issued Apr. 14, 1959. Color image transfer systems are described in Rogers U.S. Pat. Nos. 3,087,818 issued Apr. 30, 1963, 3,185,467 issued May 25, 1965, and 2,983,606 issued May 9, 1961; Weyerts et al. U.S. Pat. No. 3,253,915 issued May 31, 1966; Whitmore et al. U.S. Pat. No. 3,227,550 issued Jan. 4, 1966; Barr et al U.S. Pat. No. 3,227,551 issued Jan. 4, 1966; Whitmore et al U.S. Pat. No. 3,227,552, issued Jan. 4, 1966; Land U.S. Pat. Nos. 3,415,664, 3,415,645 and 3,415,646, all issued Dec. 10, 1968; Rogers U.S. Pat. Nos. 3,594,164 and 3,594,165 issued July 20, 1971; and Belgian Patents 757,959 and 757,960 granted Apr. 23, 1971. Each of the image-transfer systems include an image-receiving means which receives and records at least a portion of each of the images formed in the photographic emulsion layer formed according to this invention.

The photographic emulsions and elements of this invention can be used to form either direct-positive or negative photographic images. Direct-positive photographic images are typically formed by fogging the surfaces of the silver halide grains and developing using a surface developer. Fogging can be accomplished after imagewise exposure by uniform exposure to an actinic radiation source during development or by employing a nucleating or fogging agent, which can be included in the developer or in the emulsion. Using this approach those silver halide grains which are not initially imagewise exposed are developed to produce a direct positive image. To form negative images it is merely necessary to employ an internal developer—that is, one which will allow the developing agent to reach the internal latent image formed on exposure. An illustrative surface developer is Kodak Developer D-19 which has the following composition:

| | |
|---|---|
| Water at about 50° C | 500.0 cc |
| Elon developing agent ($p\text{-}CH_3NHC_6H_4OH)_2H_2SO_4$) | 2.0 grams |
| Sodium sulfite, desiccated | 90.0 grams |
| Hydroquinone | 8.0 grams |
| Sodium carbonate, monohydrated | 52.5 grams |
| Potassium bromide | 5.0 grams |
| Water to make | 1.0 liter. |

With the addition of 0.5 gram per liter of potassium iodide developer D-19 is converted to an internal developer, since the iodide cracks the silver halide grains and allows the developing agent to reach the internal latent images. Other surface and internal developers are disclosed by Porter et al. U.S. Pat. No. 3,317,322, cited above.

For purposes of this invention an internal latent image emulsion is identified as one which, when measured according to normal photographic techniques by coating a test portion of the emulsion on a transparent support, exposing to a light intensity scale for a fixed time betweem 0.01 and 1 second, bleaching 5 minutes in a 0.3 percent potassium ferricyanide solution at 20° C, and developing in an internal developer (D-19 modified by the addition of 0.5 gram per liter potassium iodide) has a sensitivity, measured at a density of 0.1 above fog, appreciably greater (e.g. 1.4 log E greater) than the sensitivity of an identical test portion which has been exposed in the same way and developed for 5 minutes at 20° C in a surface developer (D-19). Alternatively the tests disclosed in U.S. Pat. Nos. 3,586,505 and 3,178,282 can be employed.

My invention can be better appreciated by reference to the following specific embodiments:

COMPARATIVE EXAMPLE

A gelatino-silver bromide emulsion was prepared by mixing simultaneously over a period of 45 minutes at a temperature of 65° C equal molar solutions of silver nitrate and sodium bromide using a controlled halide precipitation technique to maintain a pAg of about 8. Upon completion of the precipitation, octahedral crystals having a diameter of 0.9 micron had been formed. The silver bromide emulsion was then divided into equal portions and chemically sensitized by adding amounts of sodium thiosulfate and potassium chloroaurate to the emulsion, indicated in mg of sensitizer per silver mole in Table I. The emulsions were then tested as a surface-sensitive emulsion by coating the emulsions on a film support at 11 mg of silver/dm$^2$, exposing the coated samples on a Bausch and Lomb spectrograph and developing the exposed coating for 6 minutes in Kodak Developer D-19. The following results were observed:

TABLE I

| Sodium Thiosulfate (mg/Ag mole) | Potassium Chloroaurate (mg/Ag mole) | Relative Speed | Contrast |
|---|---|---|---|
| 1.7 | 1.3 | 100 | 2.52 |
| 1.5 | 1.5 | 107 | 2.52 |
| 1.3 | 1.7 | 91 | 2.35 |

As shown in Table I the contrast of the emulsion produced having the lowest proportion of the middle chalcogen sensitizer to noble metal sensitizer decreased, as would be expected by one skilled in the art.

EXAMPLES 1–3

An emulsion was prepared, divided, and chemically sensitized as indicated in the preceding Comparative Example, but using the amounts of chemical sensitizers indicated in Table II. The chemically sensitized emulsions were further grown in the same precipitation environment as the first precipitation for an additional 40 minutes at 70° C such that the final crystalline structure (a covered grain emulsion) results in octahedral grains 1.4 microns in diameter. The emulsions were then coated, exposed and developed as in the Comparative Example, except that the developer contained 0.5 gram potassium iodide per liter. The following results were observed:

TABLE II

| Example Number | Sodium Thiosulfate (mg/Ag mole of core emulsion) | Potassium Chloroaurate | Relative Speed | Contrast |
|---|---|---|---|---|
| 1 | 2.00 | 1.00 | 100 | 0.95 |
| 2 | 1.15 | 1.15 | 95 | 1.27 |
| 3 | 1.00 | 1.50 | 118 | 1.60 |

Since iodide was added to the developer negative images were obtained similarly as with the surface-sensitized emulsion of the Comparative Example. Quite unexpectedly, however, using the internal latent image emulsions, the contrast was lowest when the middle chalcogen to noble metal sensitization was highest. Lowering the proportion middle chalcogen sensitization unexpectedly increased the obtainable contrast.

EXAMPLES 4–6

The three emulsions of Examples 1 through 3 were sensitized on the surface of the covered grains with sodium aurous(I) dithiosulfate dihydrate. The emulsions were then separately coated to form otherwise identical monochrome integral image transfer photographic elements as described in Example 2 of *Research Disclosure*, Vol. 130 , No. 13033, February 1975, but with only layers 1 through 3, 10 and 11 being present. That is, the elements consisted of a transparent film support, an image receiving layer, a reflecting layer, an opaque layer, a yellow image dye providing layer and the covered grain internal image emulsion layer containing therein a nucleating agent. Exposure and processing were as described in Example 2 of the *Research Disclosure* cited immediately above. A positive image was observed in each instance having the characteristics indicated in Table III below. From Tables II and III it is apparent that the proportion of middle chalcogen to noble metal sensitization affects the contrast of the internal latent image emulsions similarly regardless of whether the emulsions are processed to form direct-positive or negative images.

TABLE III

| Example Number | Sodium Thiosulfate (mg/Ag mole of core emulsion) | Potassium Chloroaurate (mg/Ag mole of core emulsion) | Positive Yellow Dye Image Relative Speed | Positive Yellow Dye Image Contrast |
|---|---|---|---|---|
| 4 | 2.00 | 1.00 | 83 | 0.3 |
| 5 | 1.15 | 1.15 | 100 | 0.7 |
| 6 | 1.00 | 1.50 | 126 | 0.9 |

EXAMPLES 7 AND 8

A gelatino silver bromide emulsion was prepared by mixing simultaneously over a period of 45 minutes at a temperature of 65° C equal molar solutions of silver nitrate and sodium bromide using a controlled halide precipitation technique to maintain a pAg of about 8. Upon completion of the precipitation, octahedral crystals, having a diameter of 0.9$\mu$, result. The silver bromide emulsion was divided into equal portions and chemically sensitized as described in the following table. The chemically sensitized emulsions were further grown in the same precipitation environment as the first precipitation for an additional 40 minutes at 70° C such that the final crystalline structure results in octahedral grains 1.4$\mu$ in diameter. The emulsions were then chemically sensitized at the surface of the covered grains with 0.6 mg of sodium thiosulfate/silver mole. The emulsions were then used as red-sensitized emulsions in multilayer, multicolor photographic elements according to Example 2 of *Research Disclosure*, Vol. 130, No. 13033, cited above. A positive image was observed having the contrast reported in Table IV.

TABLE IV

| Emulsion | Sodium Thiosulfate (mg/mole) | Potassium Chloroaurate (mg/mole) | Contrast of Positive cyan Dye Image |
|---|---|---|---|
| A | 0.52 | 0.79 | 2.00 |
| B | 0.75 | 0.75 | 1.15 |

The remaining portions of each emulsion described above were then blended at various ratios as described in Table V, coated, exposed and processed in a manner similar to the above-mentioned procedure. The results observed are set out in Table V.

TABLE V

| Example Number | Emulsion | Contrast of Positive Cyan Dye Image |
|---|---|---|
| 7 | A (85%)<br>B (15%) | 1.62 |
| 8 | A (70%)<br>B (30%) | 1.42 |

It can be readily observed from the above table that blending internal latent image emulsions of varied contrast provides a unique method to obtain a predetermined contrast.

The invention has been described with particular reference to preferred embodiments thereof but it will be understood that variations and modifications can be effected within the spirit and scope of the invention.

I claim:

1. A photographic silver halide emulsion comprised of silver halide grains internally sensitized with a combination of middle chalcogen and noble metal sensitizers capable of forming on exposure an internal latent image, said emulsion being the product of blending at least two silver halide emulsions each comprised of silver halide grains internally sensitized with the same middle chalcogen and noble metal sensitizers, a first of said blended emulsions being comprised of lower contrast producing silver halide grains exhibiting a comparatively higher proportion of middle chalcogen to noble metal internal sensitization and a second of said blended emulsions being comprised of higher contrast producing silver halide grains exhibiting a comparatively lower proportion of middle chalcogen to noble metal internal sensitization, said higher and lower contrast silver halide emulsions being otherwise substantially identically internally sensitized.

2. A photographic emulsion according to claim 1 in which said silver halide grains are sulfur sensitized.

3. A photographic emulsion according to claim 1 in which said silver halide grains are gold sensitized.

4. A photographic emulsion according to claim 1 in which said silver halide grains are sensitized with sulfur and gold sensitizers.

5. A photographic emulsion according to claim 1 in which said higher contrast producing silver halide grains comprise from 10 to 90 percent by weight of said silver halide grains based on total weight.

6. A photographic emulsion according to claim 1 in which said silver halide grains are surface sensitized.

7. A photographic emulsion according to claim 1 in which said silver halide grains are chosen so that when a test portion of said emulsion is coated on a transparent support and exposed to a light intensity scale for a fixed time of between 0.01 and 1 second, bleached 5 minutes in a 0.3 percent potassium ferricyanide solution at 20° C and developed for 5 minutes in a surface developer of a first composition it has a sensitivity measured at density of 0.1 above fog at least 1.4 log E less than the sensitivity of an identical test portion which has been exposed in the same way and developed for 5 minutes at 20° C in an internal developer of a second composition, wherein said first composition is as follows:

| | |
|---|---|
| water at about 50° C | 500.0 cc |
| $p\text{-}CH_3NHC_6H_4OH)_2H_2SO_4$ | 2.0 grams |
| sodium sulfite, desiccated | 90.0 grams |
| hydroquinone | 8.0 grams |
| sodium carbonate, monhydrated | 52.5 grams |
| potassium bromide | 5.0 grams |
| water to make | 1.0 liter |

and said second composition differs by the inclusion of 0.5 gram per liter of potassium iodide.

8. A photographic element including a support and, as a coating on said support, a photographic silver halide emulsion layer comprised of silver halide grains internally sensitized with a combination of the same middle chalcogen and noble metal sensitizers capable of forming on exposure an internal latent image, said emulsion layer being the product of blending at least two silver halide emulsions each comprised of silver halide grains internally sensitized with the same middle chalcogen and noble metal sensitizers, a first of said blended emulsions being comprised of lower contrast producing silver halide grains exhibiting a comparatively higher proportion of middle chalcogen to noble metal internal sensitization and a second of said blended emulsions being comprised of higher contrast producing silver halide grains exhibiting a comparatively lower proportion of middle chalcogen to noble metal internal sensitization, said higher and lower contrast silver halide grains being otherwise substantially identically internally sensitized.

9. A photographic element according to claim 8 in which said silver halide grains are sensitized with sulfur and gold sensitizers.

10. A photographic element according to claim 8 in which said higher contrast producing silver halide grains comprise from 10 to 90 percent by weight of said silver halide grains present in said emulsion layer based on total silver halide weight.

11. A photographic element according to claim 8 in which said higher contrast producing silver halide grains and said lower contrast producing silver halide grains produce a difference in contrast of greater than 0.1 when separately, but comparably, employed under the conditions of use of the photographic element.

12. A photographic element according to claim 8 comprising image-receiving means overlying said emulsion layer.

13. A process of modifying a photographic silver halide emulsion capable of forming on exposure an internal latent image to exhibit a desired characteristic curve comprising providing a first photographic silver halide emulsion comprised of silver halide grains internally sensitized with a combination of middle chalcogen and noble metal sensitizers capable of forming on exposure an internal latent image and blending therewith a second, higher contrast photographic silver halide emulsion comprised of silver halide grains internally sensitized with a relatively lower proportion of middle chalcogen to noble metal sensitization, wherein the same middle chalcogen and noble metal sensitizers are present in the first and second emulsions and said silver halide grains of said first and second emulsions are otherwise substantially identically internally sensitized.

14. A process according to claim 13 in which the first and second emulsions are sulfur sensitized.

15. A process according to claim 13 in which the first and second emulsions are gold sensitized.

16. A process according to claim 13 in which the first and second emulsions are gold and sulfur sensitized.

17. A process according to claim 13 in which the second emulsion is blended with the first emulsion in the amount of from 10 to 90 percent, based on total emulsion weight.

18. A process according to claim 13 in which the photographic silver halide emulsion is coated onto a support, imagewise exposed to electromagnetic radiation and developed in an internal developer to produce a negative photographic image.

19. A process according to claim 13 in which the photographic silver halide emulsion is coated onto a support, imagewise exposed to electromagnetic radiation and developed in a surface developer under nucleating conditions to produce a direct-positive image.

20. A process according to claim 13 in which the photographic silver halide emulsion is coated onto a support, imagewise exposed to electromagnetic radiation, developed to form an image and an image-receiving means is positioned to receive at least a portion of the image.

* * * * *